US006993946B1

(12) United States Patent
Shen

(10) Patent No.: US 6,993,946 B1
(45) Date of Patent: Feb. 7, 2006

(54) LOCK WITH CLUTCHING FUNCTION

(75) Inventor: Mu-Lin Shen, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 0 days.

(21) Appl. No.: 10/988,677

(22) Filed: Nov. 15, 2004

(51) Int. Cl.
*E05B 13/00* (2006.01)

(52) U.S. Cl. ..... 70/472; 70/107; 70/149; 70/218; 292/169.22; 292/DIG. 27

(58) Field of Classification Search ..... 70/107–110, 70/188, 189, 221–224, 149, 218, 422, 472, 70/277, 279.1; 292/DIG. 27, 169.21, 169.22, 292/169.23
See application file for complete search history.

(56) References Cited

U.S. PATENT DOCUMENTS

| | | | | | |
|---|---|---|---|---|---|
| 264,575 | A * | 9/1882 | Simon | 70/149 |
| 4,108,482 | A * | 8/1978 | Dietrich et al. | 292/165 |
| 4,583,382 | A | 4/1986 | Hull | 70/107 |
| 5,890,385 | A * | 4/1999 | Lee | 70/472 |
| 6,581,423 | B2 * | 6/2003 | Lin | 70/107 |
| 6,619,705 | B2 * | 9/2003 | Dalsing | 292/169.14 |
| 6,622,535 | B2 * | 9/2003 | Chiang et al. | 70/107 |
| 6,640,594 | B1 * | 11/2003 | Yao | 70/277 |
| 6,837,081 | B2 * | 1/2005 | Ruano Aramburu et al. | 70/218 |
| 6,895,791 | B2 * | 5/2005 | Alexander et al. | 70/277 |
| 6,935,149 | B1 * | 8/2005 | Peng et al. | 70/472 |
| 2003/0019256 | A1 * | 1/2003 | Frolov | 70/222 |

* cited by examiner

*Primary Examiner*—Lloyd A. Gall
(74) *Attorney, Agent, or Firm*—Alan D. Kamrath; Nikolai & Mersereau, P.A.

(57) ABSTRACT

A lock includes an inside handle, an outside handle, and a body between the handles. A spindle is mounted to each handle to turn therewith. Two pivotable wheels are mounted in the case and operably connected to the inside and outside spindles and a latch bolt such that turning of either handle causes retraction of the latch bolt. One of the wheels engaging with the outside spindle includes a notch communicated with a through-hole of the wheel. A lever extends through the notch of the wheel and includes an end in the through-hole of the notched wheel. When a locking plug is moved to a blocking position, the end of the lever sways to move the outside spindle out of the through-hole of the notched wheel such that the outside handle turns idly when the outside handle is turned.

10 Claims, 11 Drawing Sheets

LOCK WITH CLUTCHING FUNCTION

BACKGROUND OF THE INVENTION

1. Field of the Invention

The present invention relates to a lock. In particular, the present invention relates to a lock with a clutch function, allowing free rotation of the outer handle when the lock is in a locked state.

2. Description of the Related Art

U.S. Pat. No. 4,583,382 discloses a door lock with a reversible latch assembly with integrated function. The door lock comprises a generally rectangular case, a latch bolt disposed in the case, and a dead bolt disposed in the case. The case includes a front plate for confronting a door frame. A portion of the latch bolt is selectively extensible from the front plate of the case for securing relative movement between the door and the door frame. A portion of the dead bolt is selectively extensible from the front plate of the case for further securing relative movement between the door and the door frame. An outside handle is provided on the outside of a side of the case for selectively retracting the latch bolt disposed on. An inner handle is disposed on the inside of the case of simultaneously retracting the latch bolt and the dead bolt.

A stop works catch is provided within the case for securing at least one of the inside handle and the outside handle against operation. A thumb turn is operable from the inside of the door for selectively releasing the stop works catch and retracting the dead bolt in a first position, deploying the stop works catch in a second position and deploying the stop works catch and extending the dead bolt in a third position. A lock core is operable from the outside side of the door for selectively retracting the latch bolt and the dead bolt. When the dead bolt is extended, operation of the lock core is prevented. The door lock further includes an inner and an outer retractor hub means which are axially aligned and mounted for independent rotation within the case. The inner retractor hub means is located adjacent to the inner side of the case and operated by the inside handle. The outer retractor hub means is located adjacent to the outside side of the case and operated by the outside handle.

The stop works catch is provided with a recess which cooperates with a projection on the outer retractor hub means to prevent rotation of the outer retractor hub means. Thus, the outside handle could not be turned when in a locked state. However, the internal parts of the door lock could be damaged if the outside handle is frequently depressed when the user is not aware of the locking state of the lock. Also, the internal parts of the door lock could be damaged if the outside handle is depressed with a relatively large force when the user is not aware of the locking state of the lock. The life of the door lock is shortened.

SUMMARY OF THE INVENTION

In accordance with a first aspect of the present invention, a lock comprises:

an inside handle including an end;

an inside spindle mounted to the end of the inside handle to turn therewith;

an outside handle including an end;

an outside spindle mounted to the end of the outside handle to turn therewith;

a body mounted between the inside handle and the outside handle, the body comprising a case and a lid for covering the case, the case including a front end face and a lateral side, an opening being defined in the front end face of the case, a latch bolt being retractably extended through the opening;

a first wheel pivotally mounted in the lateral side of the case, the first wheel including a through-hole into which the outside spindle extends, allowing joint rotation of the first wheel and the outside spindle, the first wheel being operably connected to the latch bolt such that turning of the first wheel causes retraction of the latch bolt, the first wheel further including a notch defined in a periphery thereof and communicated with the through-hole of the first wheel;

a second wheel pivotally mounted in the lid and including a through-hole into which the inside spindle extends, allowing joint rotation of the second wheel and the inside spindle, the second wheel being operably connected to the latch bolt such that turning of the second wheel causes retraction of the latch bolt;

a spring mounted in the end of the outside handle for biasing an end of the outside spindle into the through-hole of the first wheel, allowing joint rotation of the first wheel and the outside spindle;

a lever including a first end and a second end, the lever swayably extending through the notch of the first wheel, with the first end of the lever being located outside the first wheel and with the second end of the lever being located in the through-hole of the first wheel; and a locking plug mounted in the case and movable between an unblocking position in which the latch bolt is retracted when either of the inside handle and the outside handle is turned and a blocking position in which the latch bolt is retracted when the inside handle is turned;

wherein when the locking plug is in the blocking position, the locking plug presses against the first end of the lever and thus causes swaying movement of the lever, moving the second end of the lever to press against the end of the outside spindle to thereby move the outside spindle out of the through-hole of the first wheel such that the first wheel is not turned while the outside spindle is turned.

A bottom wall delimiting the notch of the first wheel includes a pointed protrusion acting a fulcrum for the lever. The lever includes a recessed portion abutting against a bottom wall delimiting the notch of the first wheel. The end of the outside spindle is located at an outer side of the second end of the lever.

In accordance with a second aspect of the invention, a lock comprises:

a first handle including an end;

a first spindle mounted to the end of the first handle to turn therewith;

a second handle including an end;

a second spindle mounted to the end of the second handle to turn therewith;

a body mounted between the first handle and the second handle, the body comprising a case including two lateral sides and a front end face, an opening being defined in the front end face of the case, a latch bolt being retractably extended through the opening;

a first wheel pivotally mounted in the lateral side of the case, the first wheel including a through-hole into which the first spindle extends, the first wheel being operably connected to the latch bolt such that turning of the first wheel causes retraction of the latch bolt, the first wheel further including a notch defined in a periphery thereof and communicated with the through-hole of the first wheel;

a second wheel pivotally mounted in the lid and including a through-hole into which the second spindle extends, the second wheel being operably connected to the latch bolt such that turning of the second wheel causes retraction of the latch bolt;

a first spring mounted in the end of the first handle for biasing an end of the first spindle into the through-hole of the first wheel, allowing joint rotation of the first wheel and the first spindle;

a second spring mounted in the end of the second handle for biasing an end of the second spindle into the through-hole of the second wheel, allowing joint rotation of the second wheel and the second spindle;

a first lever including a first end and a second end, the first lever swayably extending through the notch of the first wheel, with the first end of the first lever being located outside the first wheel and with the second end of the first lever being located in the through-hole of the first wheel;

a second lever including a first end and a second end, the second lever swayably extending through the notch of the second wheel, with the first end of the second lever being located outside the second wheel and with the second end of the second lever being located in the through-hole of the second wheel; and a locking plug mounted in the case and movable between an unblocking position in which the latch bolt is retracted when either of the first handle and the second handle is turned and a blocking position in which the latch bolt is retracted when one of the first handle and the second handle is turned;

the locking plug being selectively mounted in one of two positions for selectively operating with one of the first lever and the second lever;

when the locking plug is in the blocking position, the locking plug presses against the first end of an associated one of the first lever and the second lever and thus causes swaying movement of the associated one of the first lever and the second lever, moving the second end of the associated one of the first lever and the second lever to press against the end of an associated one of the first spindle and the second spindle to thereby move the associated one of the first spindle and the second spindle out of the through-hole of an associated one of the first wheel and the second wheel such that the associated one of the first wheel and the second wheel is not turned while the other one of the first handle and the second handle is turned.

A bottom wall delimiting the notch of each of the first wheel and the second wheel includes a pointed protrusion acting a fulcrum for the associated one of the first lever and the second lever. Each of the first lever and the second lever includes a recessed portion abutting against a bottom wall delimiting the notch of the associated one of the first wheel and the second wheel.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
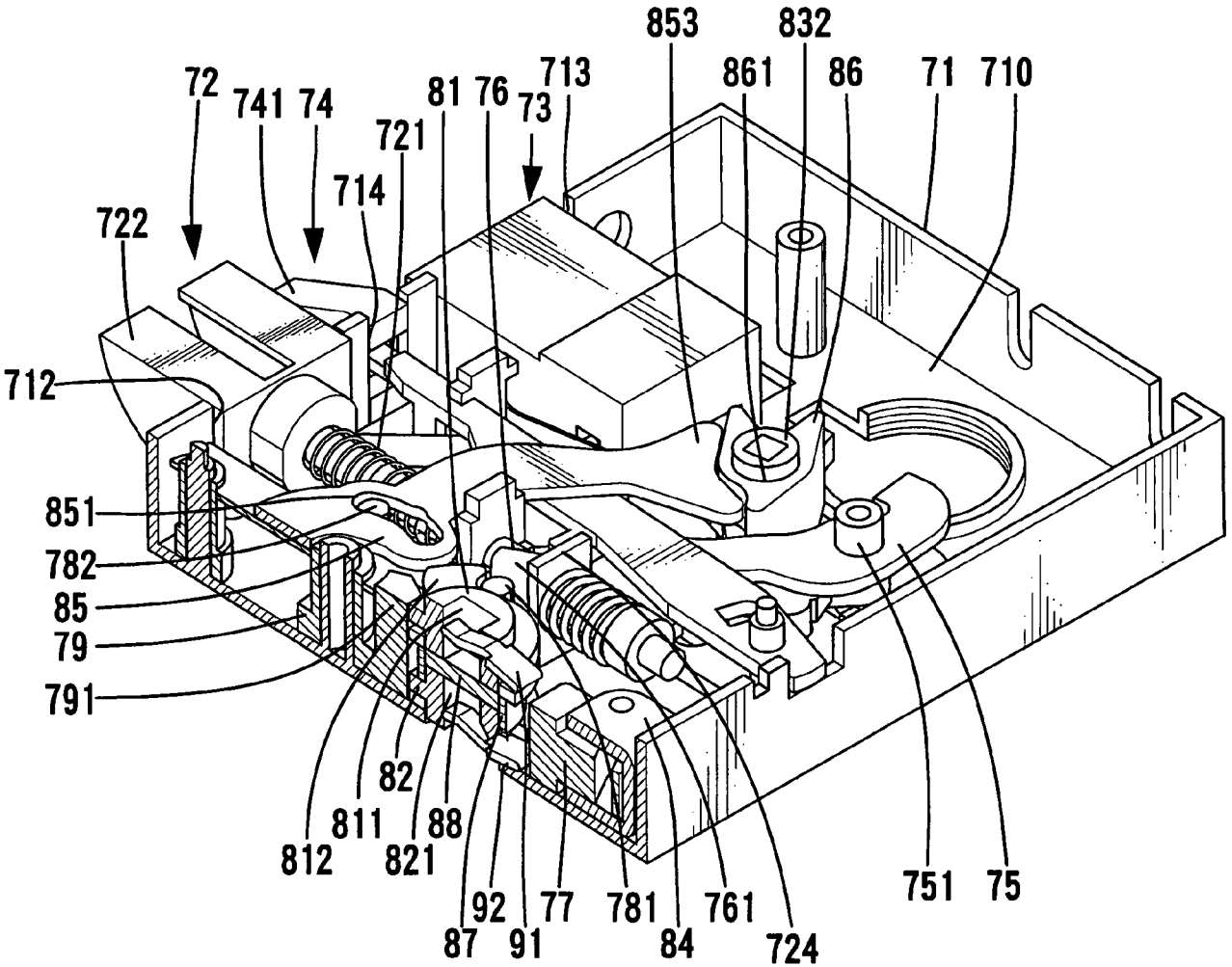
FIG. 1 is a perspective view, partly cutaway and partly removed, of a lock in accordance with the present invention.
Figure 2:
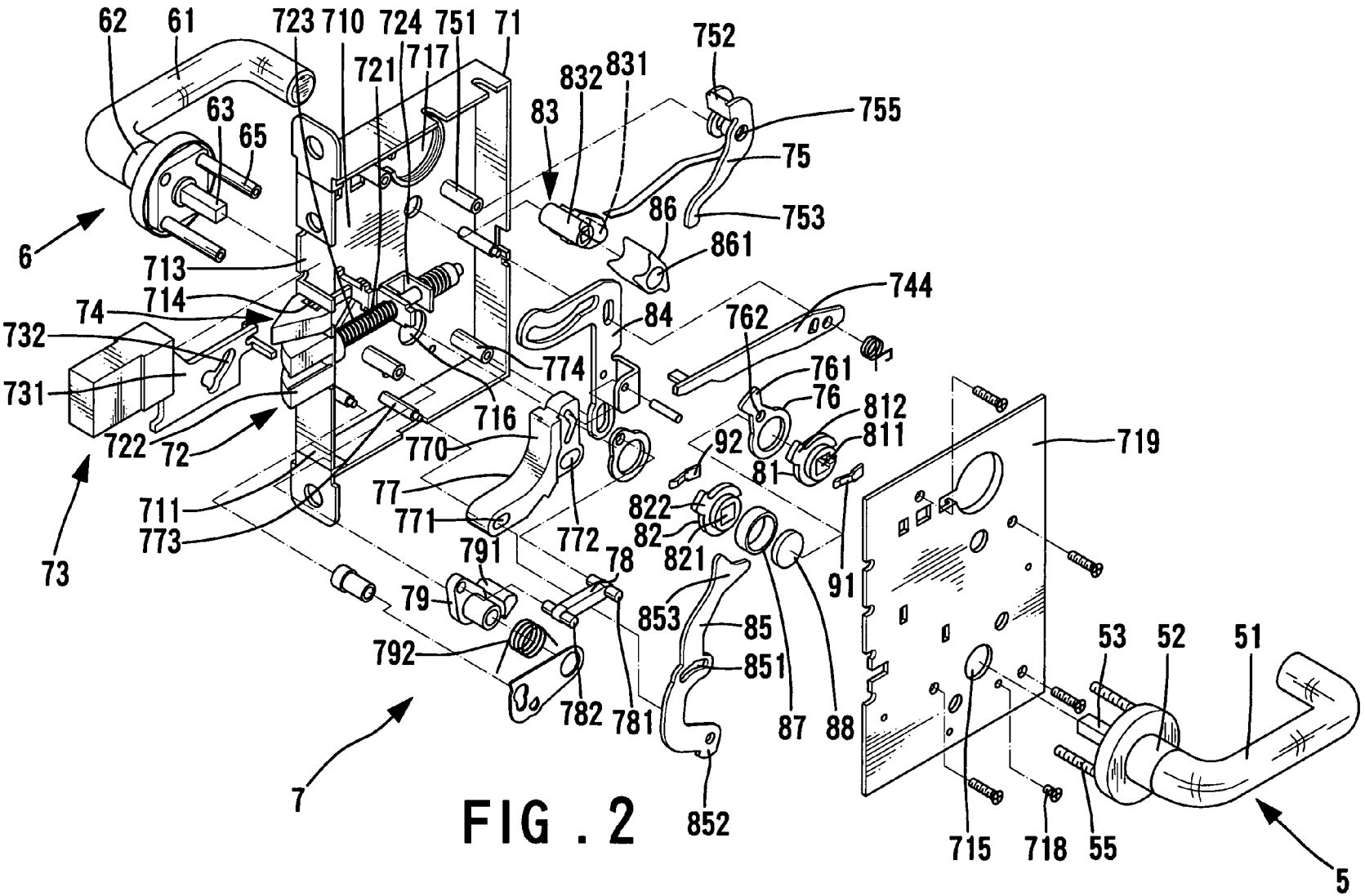
FIG. 2 is an exploded perspective view of the lock in accordance with the present invention.
Figure 3:
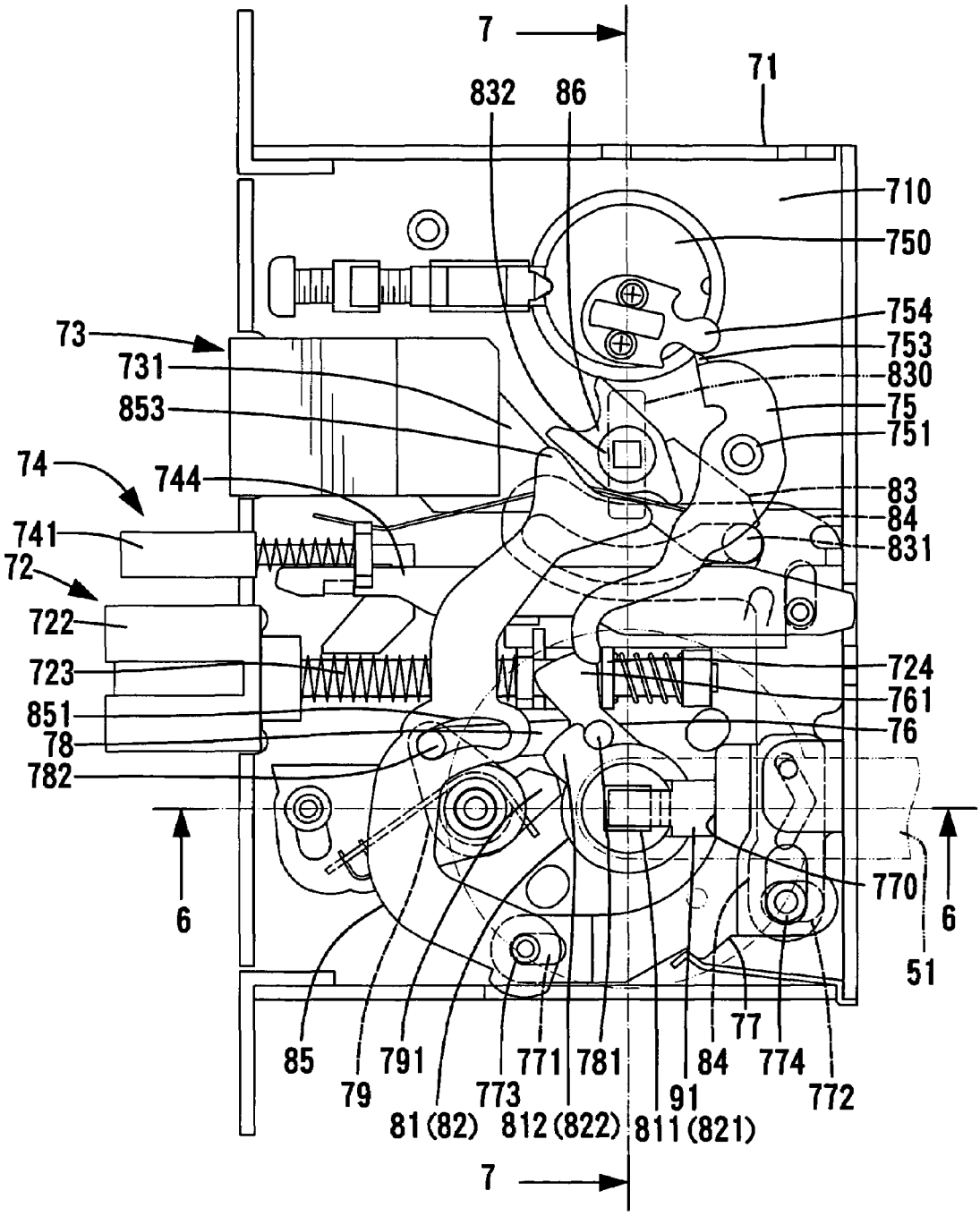
FIG. 3 is an elevational view of the lock mounted to a door.

Referring to FIGS. 1 through 3, a lock in accordance with the present invention comprises an inside handle assembly 5, an outside handle assembly 6, and a body 7 between the inside and outside handle assemblies 5 and 6.

The inside handle assembly 5 includes an inside handle 51, an inside spindle 53 mounted to an end 52 of the inside handle 51. The outside handle assembly 6 includes an outside handle 61, an outside spindle 63 mounted to an end 62 of the outside handle 61. The inside handle assembly 5 and the outside handle assembly 6 are assembled together and respectively fixed to two sides of the body 7 by bolts 55 and mounting rods 65 with screw holes (not labeled). The inside and outside spindles 53 and 63 are square in this embodiment.

The body 7 is mounted in a groove or compartment 90 in a door 9 and includes a case 71 and a lid 719 for covering the case 71. The case 71 includes an outer end face 711 having three openings 712 (FIG. 1), 713, and 714 into which a latch bolt 72, a dead bolt 73, and an auxiliary bolt 74 are respectively mounted. The case 71 further includes a lateral side 710 having a hole 716 that is aligned with a hole 715 in the lid 719 that forms the other lateral side of the case 71 after assembly. A wheel 81 is pivotably mounted in the hole 715 of the lid 719 and includes a square through-hole 811 through which the inside spindle 53 extends. Another wheel 82 is pivotably mounted in the hole 716 of the lateral side 710 of the case 7 and includes a square through-hole 821 through which the outside spindle 63 extends. Turning of either handle 51, 61 causes pivotal movement of the associated wheel 81, 82. Each wheel 81, 82 further includes a tooth 812, 822. Further, the wheels 81 and 82 are spaced from each other by a spacer ring 87 and a spacer disc 88.

The latch bolt 72 includes a head 722 and a shank 721 extending from the head 722 through the opening 712. The head 722 of the latch bolt 72 is normally biased by a spring 723 to an extended, latching position outside the case 71. A substantially U-shaped bracket 724 is mounted on the shank 721 of the latch bolt 72 and drivable by a lever link 75 or a drive member 76, which will be described later.

The auxiliary bolt 74 includes a head 741 that is normally biased to an extended position outside the case 71. When the door is closed, the auxiliary bolt 74 moves inward, moving a stop plate 744 downward to a position on the retracting path of the latch bolt 72, thereby preventing retraction of the latch bolt 72 into the case 71. Thus, the door cannot be unlatched by using a card to press the latch bolt 72 inward.

The lever link 75 is mounted in the case 71 and pivotable about a pivot 751. The lever link 75 includes an intermediate portion 755 pivotally mounted around the pivot 751, a first end 752, and a second end 753 engaged with the bracket 724 of the latch bolt 72. A lock core 750 is rotatably mounted in a hole 717 in the lateral side 710 of the case 71 and includes an actuating member 754. In a case that the dead bolt 73 is in an extended, locking position, when the lock core 750 is turned by a key, the dead bolt 73 is firstly retracted. Further turning of the lock core 750 causes the actuating member 754 to engage with the first end 752 of the lever link 75 and to turn of the lever link 75. The bracket 724 of the shank 71 is moved inward by the second end 753 of the lever link 75, thereby retracting the latch bolt 72. Inward movement of the bracket 724 causes upward pivotal movement of the stop plate 744, thereby clearing the retracting path for the latch bolt 72.

The drive member 76 is mounted between the wheels 81 and 82 and includes a lug 761 for pushing the bracket 724 of the latch bolt 72. A linking member 78 is also mounted in the case 71 and includes a first pin 781 on an end thereof and a second pin 782 on the other end thereof. The first pin 781 extends through a hole 762 in the lug 761. A cam 79 is rotatably mounted to the lateral side 710 of the case 71 and engaged with the second pin 782. The cam 79 includes a projection 791.

When either wheel 81, 82 is turned clockwise through operation of the associated handle 51, 61 (see FIG. 4), the tooth 812, 822 of the wheel 81, 82 pushes the first pin 781 clockwise, causing clockwise movement of the lug 761, which, in turn, moves the bracket 724 inward, thereby retracting the latch bolt 72.

On the other hand, when either wheel 81, 82 is turned counterclockwise, the tooth 812, 822 of the wheel 81, 82 pushes against the projection 791 on the cam 79, causing rotation of the cam 79. The lug 761 of the drive member 76 is moved inward though transmission by the linking member 78. Thus, the latch bolt 72 is retracted. A spring 792 is mounted to the cam 79 for returning the wheel 81, 82 such that the tooth 812, 822 of the wheel 81, 82 is closely located between the lug 761 and the projection 791, avoiding play during rotation of either handle 51, 61.

Also mounted in the case 71 and located adjacent to the wheel 82 is a locking plug 77 comprising two slots 771 and 772 in which two pivots 773 and 774 are slidably received. The locking plug 77 further includes a face 770.

A pivotal member 83 is pivotally mounted to the lateral side 710 of the case 71 and includes an axle 832 and an actuating portion 831. The actuating portion 831 is slidably received in a slot 732 of the shank 731 of the dead bolt 73. When the pivotal member 83 is turned by turning the thumb turn 830, the dead bolt 73 is moved between the extended, locking position and a retracted, unlocking position. A thumb turn 830 is engaged with the pivotal member 83 to turn therewith. A cam 86 includes a longitudinal hole 861 for securely engaging with the axle 832 of the pivotal member 83, allowing joint rotation of the cam 86 and the pivotal member 83. A follower plate 84 is mounted in the case 70 and connected to the locking plug 77 so that upward/downward movement (as viewed from FIG. 3) of the follower plate 84 causes leftward/rightward movement (as viewed from FIG. 3) of the locking plug 77. When the thumb turn 830 is turned while the dead bolt 73 remains in the retracted, locking position, the pivotal member 83 pivots, and the actuating portion 831 drives the follower plate 84 to move upward/downward, thereby moving the locking plug 77 leftward/rightward.

The second pin 782 of the linking member 78 extends through a slot 851 of a rocker arm 85 that is pivotally mounted in the case 71 at a first end 852 thereof. A second end 853 of the rocker arm 85 abuts against the cam 86 that turns jointly with the pivotal member 83. When the dead bolt 73 is in the extended, locking position, turning of the inside handle 51 causes turning of the wheel 82, which, in turn, causes the cam 79 to turn clockwise. The second end 853 of the rocker arm 85 presses against the cam 86 and thus turns the pivotal member 83 to retract the dead bolt 73 into the case 71, achieving the unlocking function. Of course, turning of the inside handle 51 also unlatches the latch bolt 72.

Figure 8:
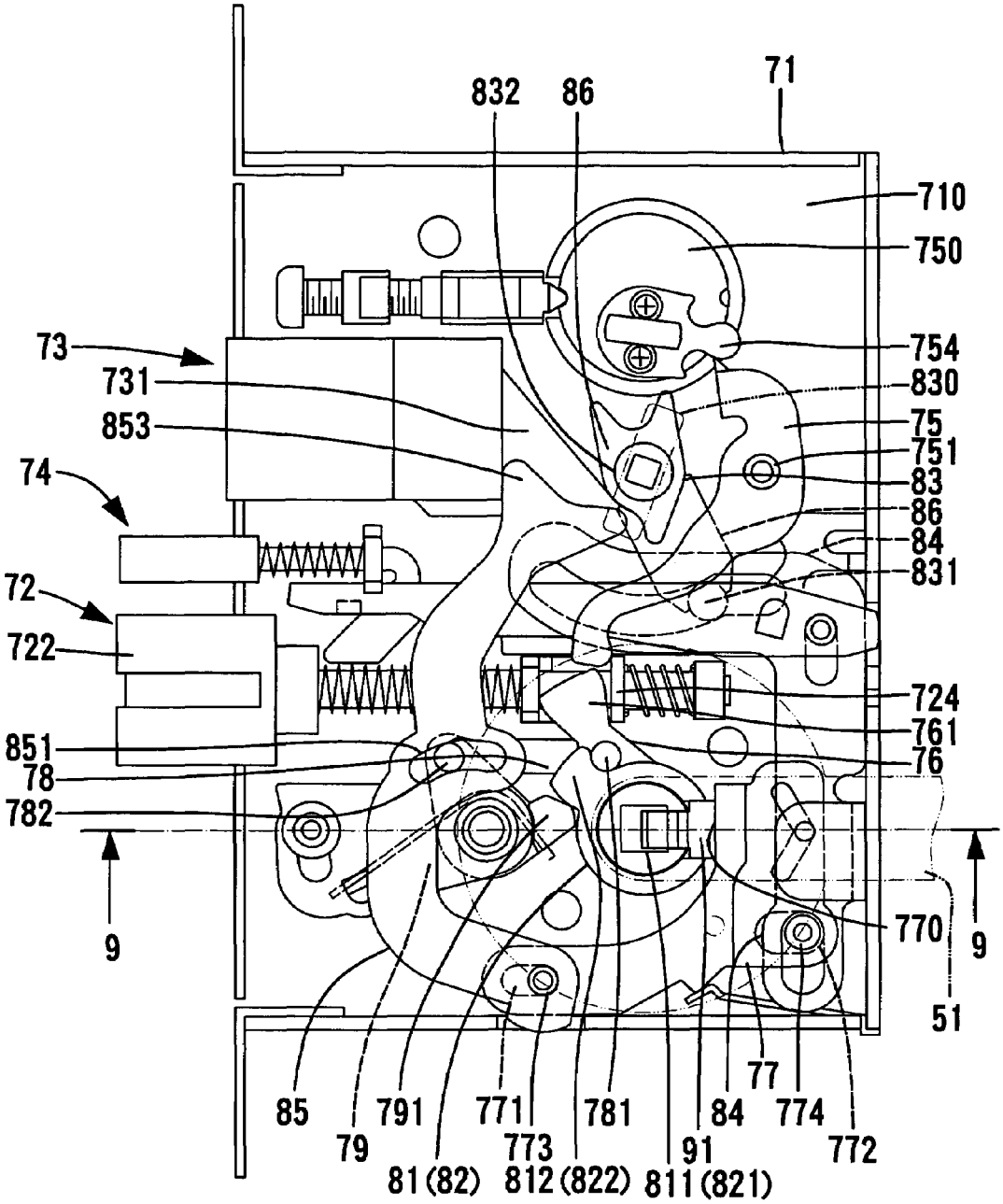
FIG. 8 is a view similar to FIG. 3, wherein a locking plug is moved leftward to lock the latch bolt.

The thumb turn 830 is movable between an unblocking position (in which the follower plate 84 is in its upper position, the locking plug 77 is in its right, unblocking position not engaging with the tooth 813, 823 of the associated wheel 81, 82, and the dead bolt 73 is in its retracted state, see FIG. 3), a blocking position (in which the follower plate 84 is in its lower position, the locking plug 77 is in its left, blocking position engaging with the tooth 813, 823 of the associated wheel 81, 82, and the dead bolt is in its retracted state, see FIG. 8), and a locking position (in which the follower plate 84 is in its lower position, the locking plug 77 is in its left, blocking position engaging with the tooth 813, 823 of the associated wheel 81, 82, and the dead bolt is in its extended state).

The above structure and operations are conventional. Of more importance, at least one of the wheels 81 and 82 includes a notch communicated with the through-hole 811, 821.

Figure 5:
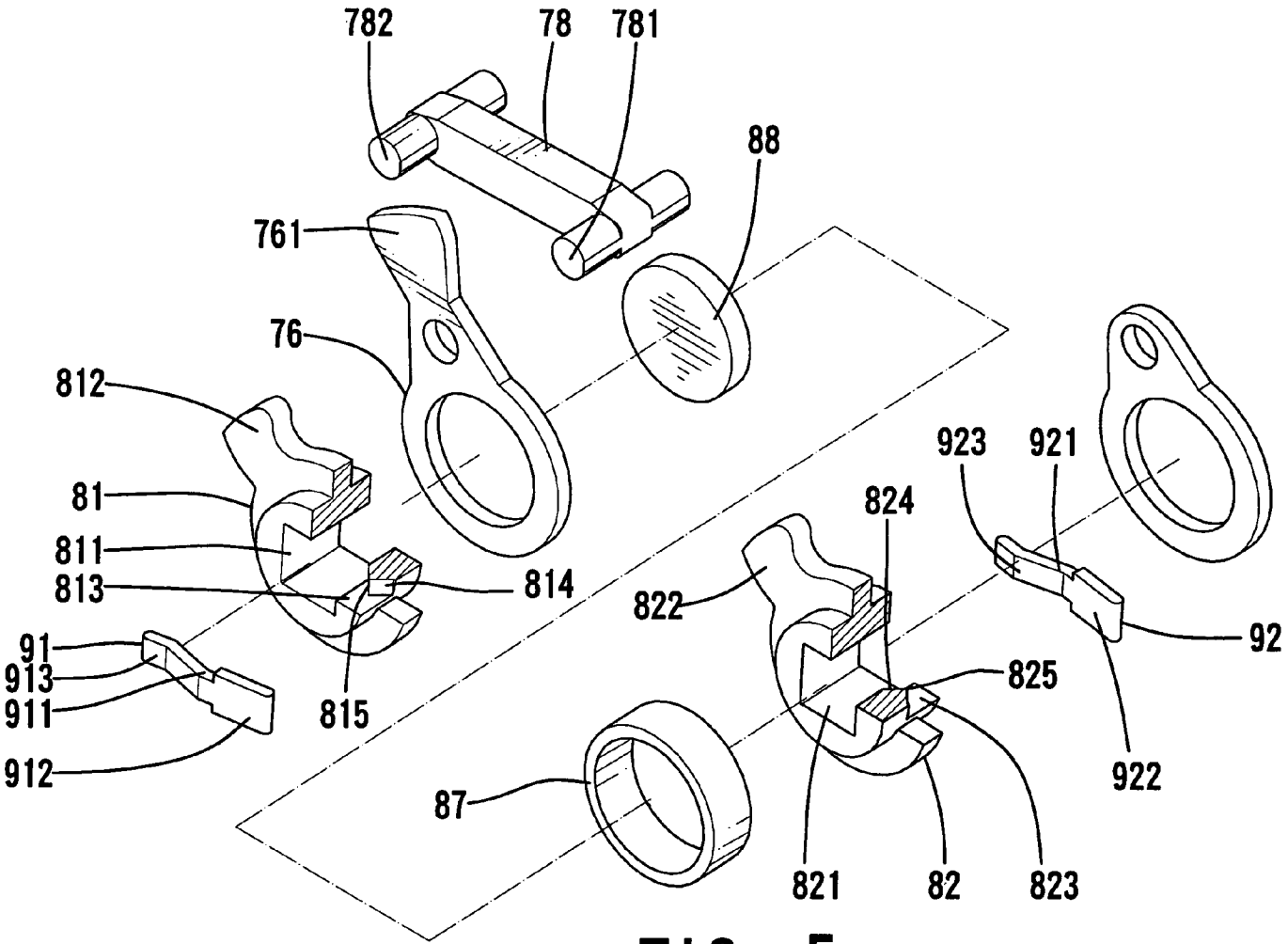
FIG. 5 is an exploded perspective view of several elements of the lock in accordance with the present invention.
Figure 6:
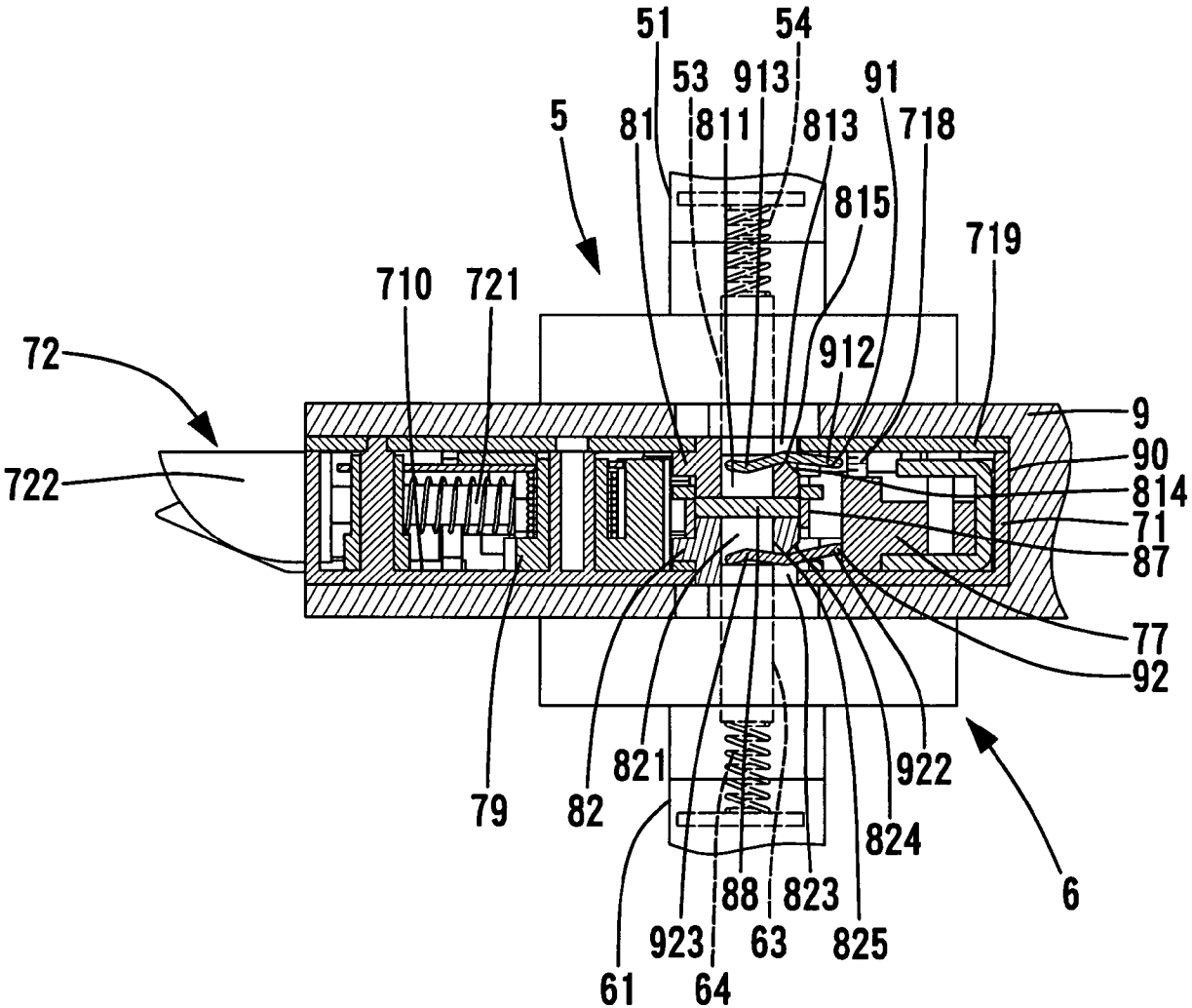
FIG. 6 is a sectional view taken along plane 6—6 in FIG. 3.

Referring to FIGS. 1, 5, and 6, in the illustrated embodiment, each wheel 81, 82 includes a notch 813, 823 defined in a periphery thereof and communicated with the longitudinal through-hole 811, 821. Further, two levers 91 and 92 are provided. Each lever 91, 92 is a substantially bent plate and includes a recessed portion 911, 921 abutting against a bottom wall 814, 824 delimiting the notch 813, 823. Each lever 91, 92 further includes a first end 912, 922 outside the wheel 81, 82 and a second end 913, 923 located in the through-hole 811, 821.

Preferably, the bottom wall 814, 824 providing a fulcrum for the lever 91, 92 includes a pointed protrusion 815, 825 to allow smooth swaying motion of the lever 91, 92. The depth of the notch 813, 823 is so selected that when the second end 913, 923 of the lever 91, 92 sways toward the associated handle 51, 61, the second end 913, 923 of the lever 91, 92 sways to a position out of the through-hole 811, 821 of the wheel 81, 82.

Figure 7:
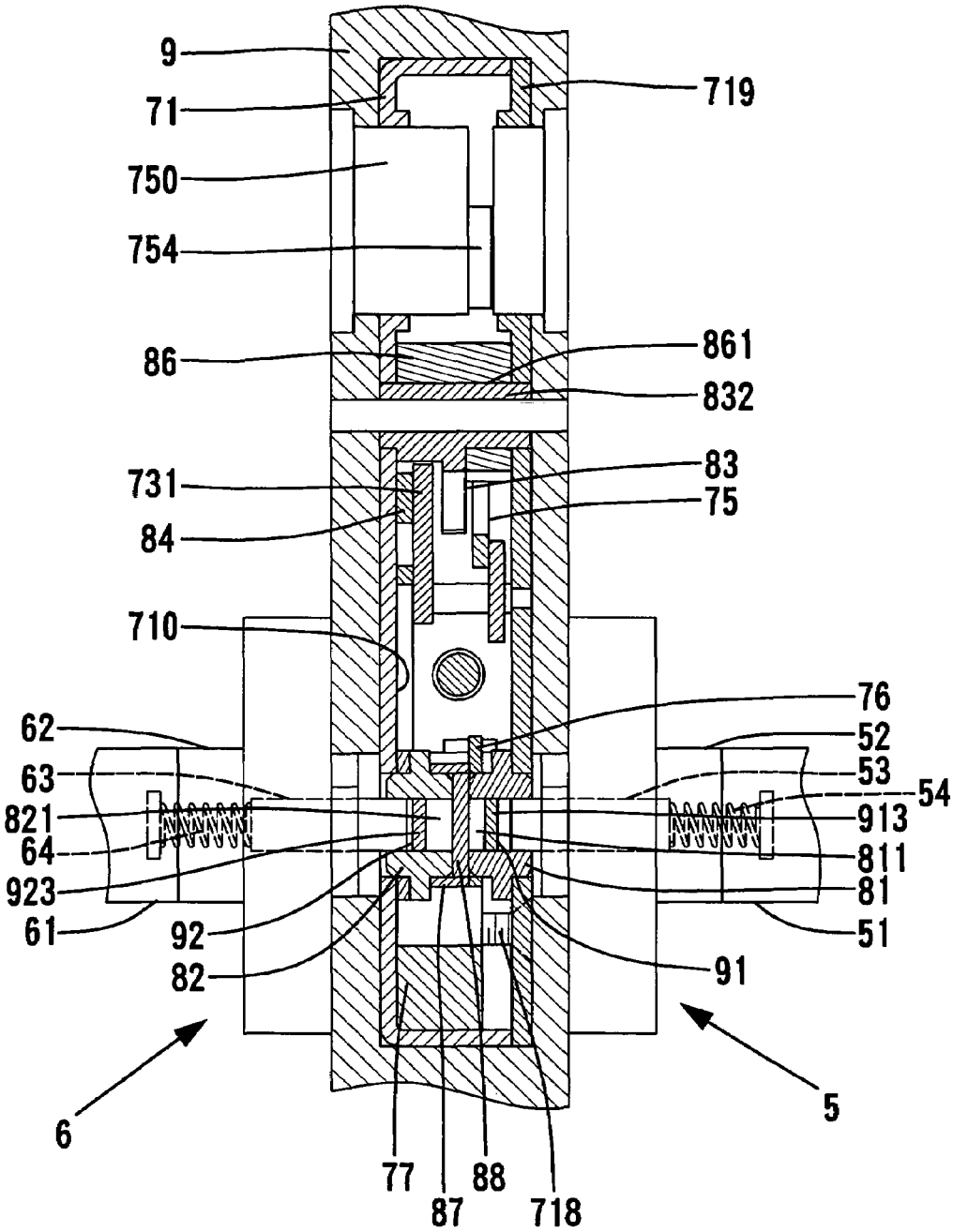
FIG. 7 is a sectional view taken along plane 7—7 in FIG. 3.

Referring to FIG. 7, a spring 64 is attached to an outer end of the outside spindle 63 to bias an inner end (the right one in FIG. 7) of the outside spindle 63 into the through-hole 811 of the wheel 81 and located at an outer side of the second end 923 of the lever 92. Similarly, a spring 54 is attached to an outer end of the inside spindle 53 to bias an inner end (the left one in FIG. 7) of the inside spindle 53 into the through-hole 821 of the wheel 82 and located at an outer side of the second end 913 of the lever 91.

Figure 4:
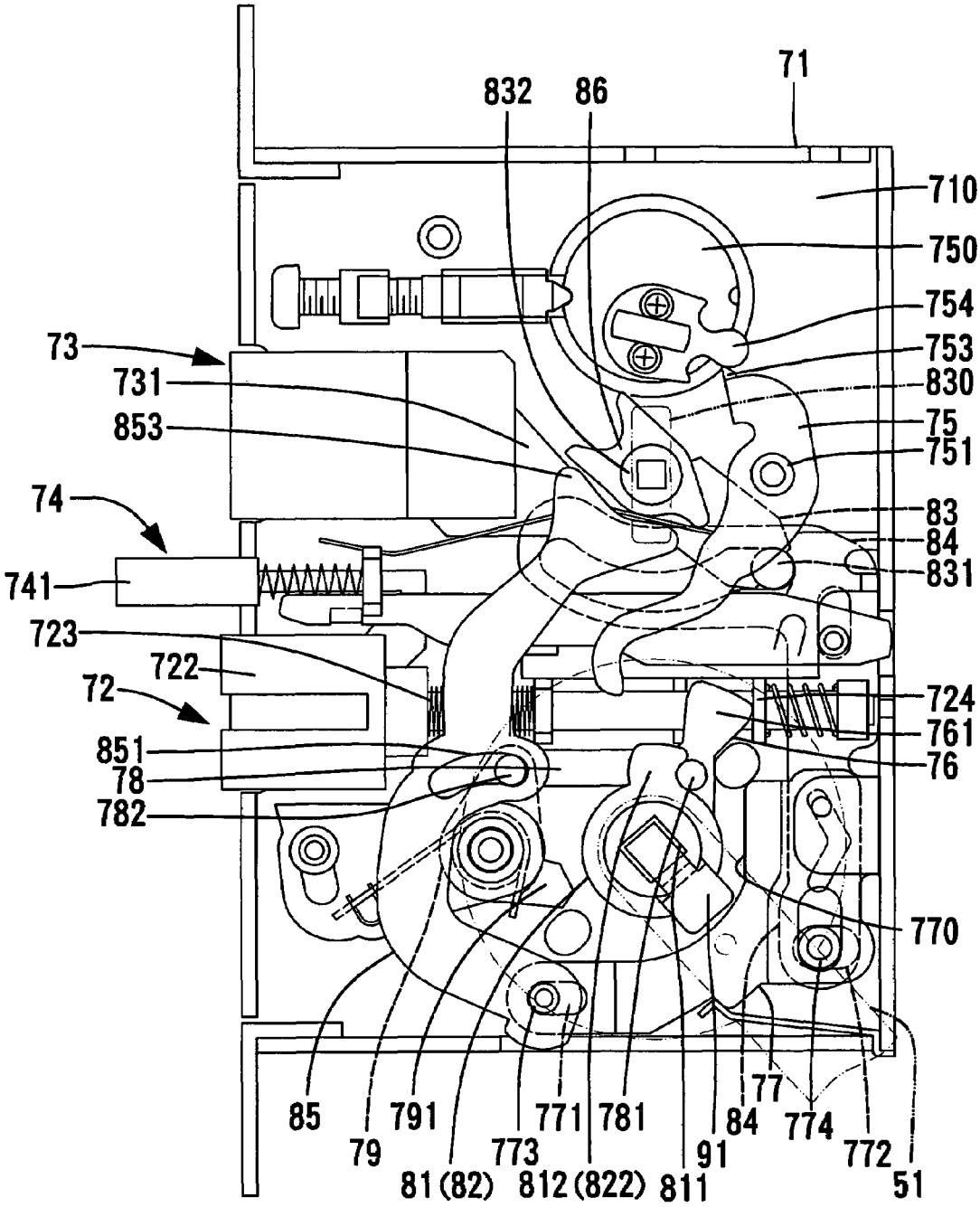
FIG. 4 is a view similar to FIG. 3, wherein a latch bolt is retracted upon turning of either handle of the lock.

Referring to FIGS. 3 and 4, when the lock is in an unlocked state, operation of either handle 51, 61 causes rotation of the wheel 81, 82, resulting in retraction of the latch bolt 72, as mentioned above.

Figure 9:
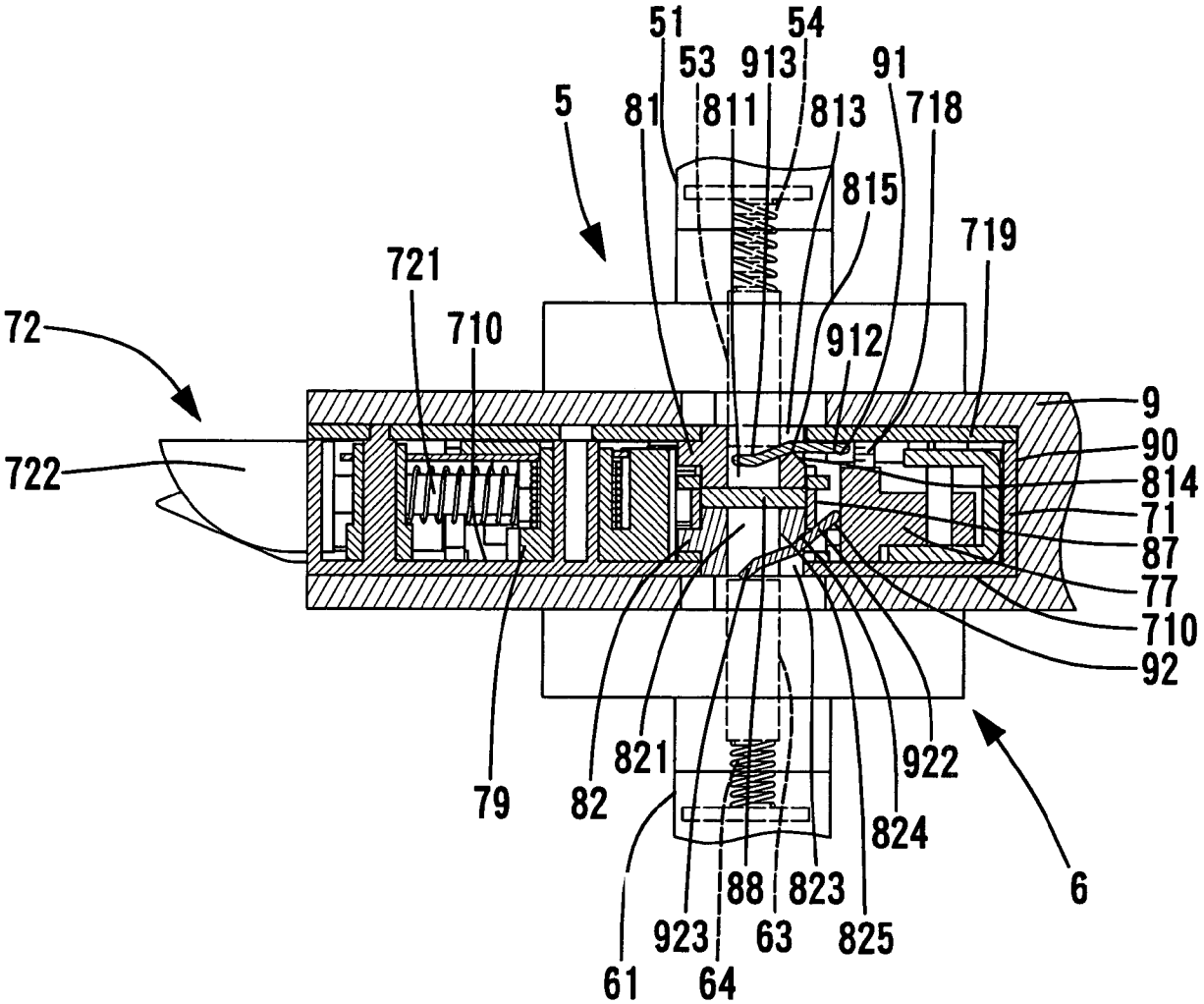
FIG. 9 is a sectional view taken along plane 9—9 in FIG. 8.

When the thumb turn 830 is in the blocking position shown in FIG. 8, the face 770 of the locking plug 77 presses against the first end 922 of the lever 92 such that the second end 923 of the lever 92 presses against the outside spindle 63 and thus disengages the outside spindle 63 from the through-hole 821 of the wheel 82, as shown in FIG. 9. Thus, the latch bolt 72 is not retracted when the outside spindle 61 is turned, as the wheel 82 is not turned. In other words, the outside handle 61 pivots idly, preventing the internal elements of the lock from being damaged in a case that a relatively large force is applied to the outside handle 61. Operation of the inside handle 51 is not affected, as the inside spindle 53 is not moved.

Figure 10:
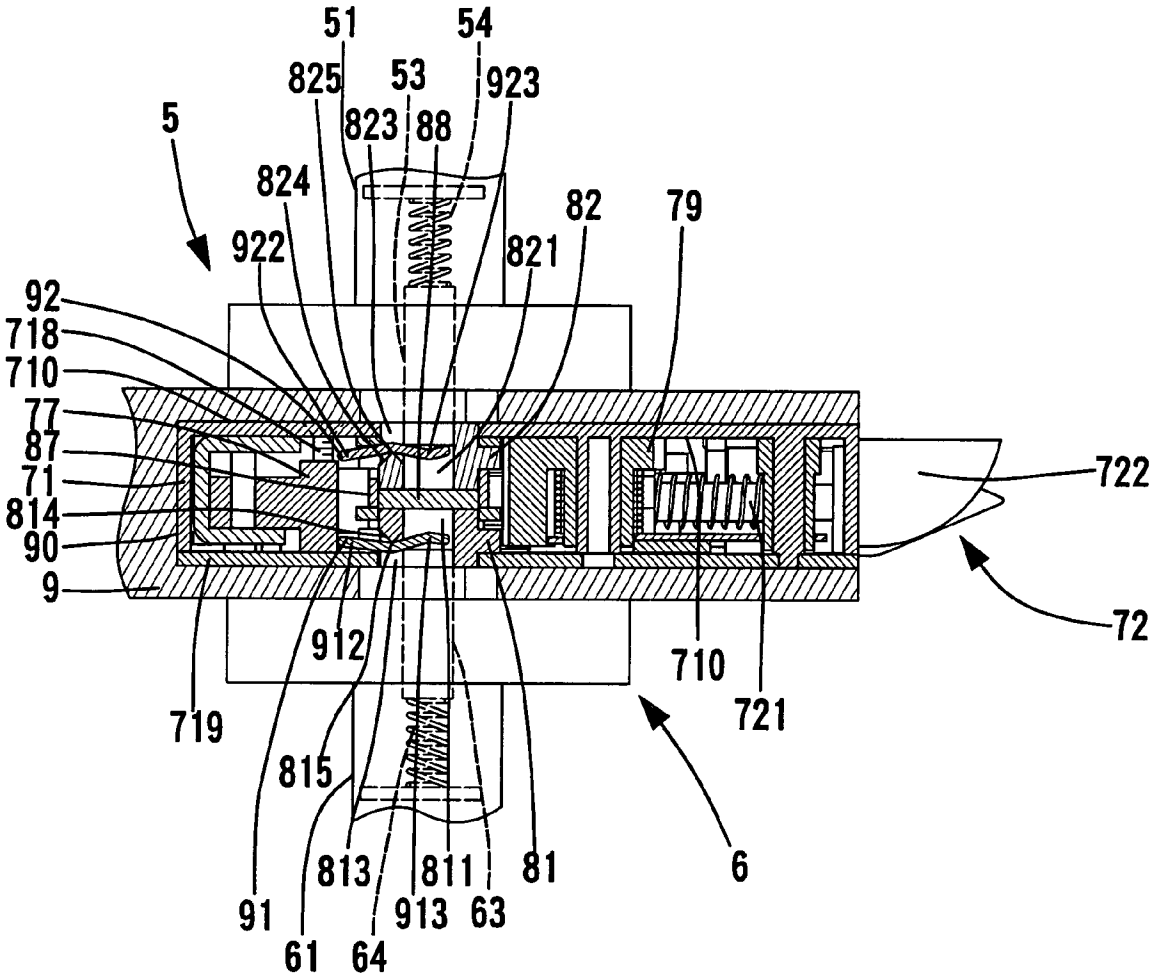
FIG. 10 is a sectional view illustrating mounting of the lock to a differently handed door.

FIG. 10 shows different mounting of the lock in response to a differently handed door. The locking plug 77 is moved from a position pressing against the lateral side 710 of the case 71 (see FIG. 9) to a position pressing against the lid 719 (see FIG. 10). Screws 718 are provided to fix the locking plug 77. In this case, the direction of the latch bolt 73 is changed. Further, the outside spindle 63 engages with the through-hole 811 of the wheel 81 whereas the inside spindle 53 engages with the through-hole 821 of the wheel 82.

Figure 11:
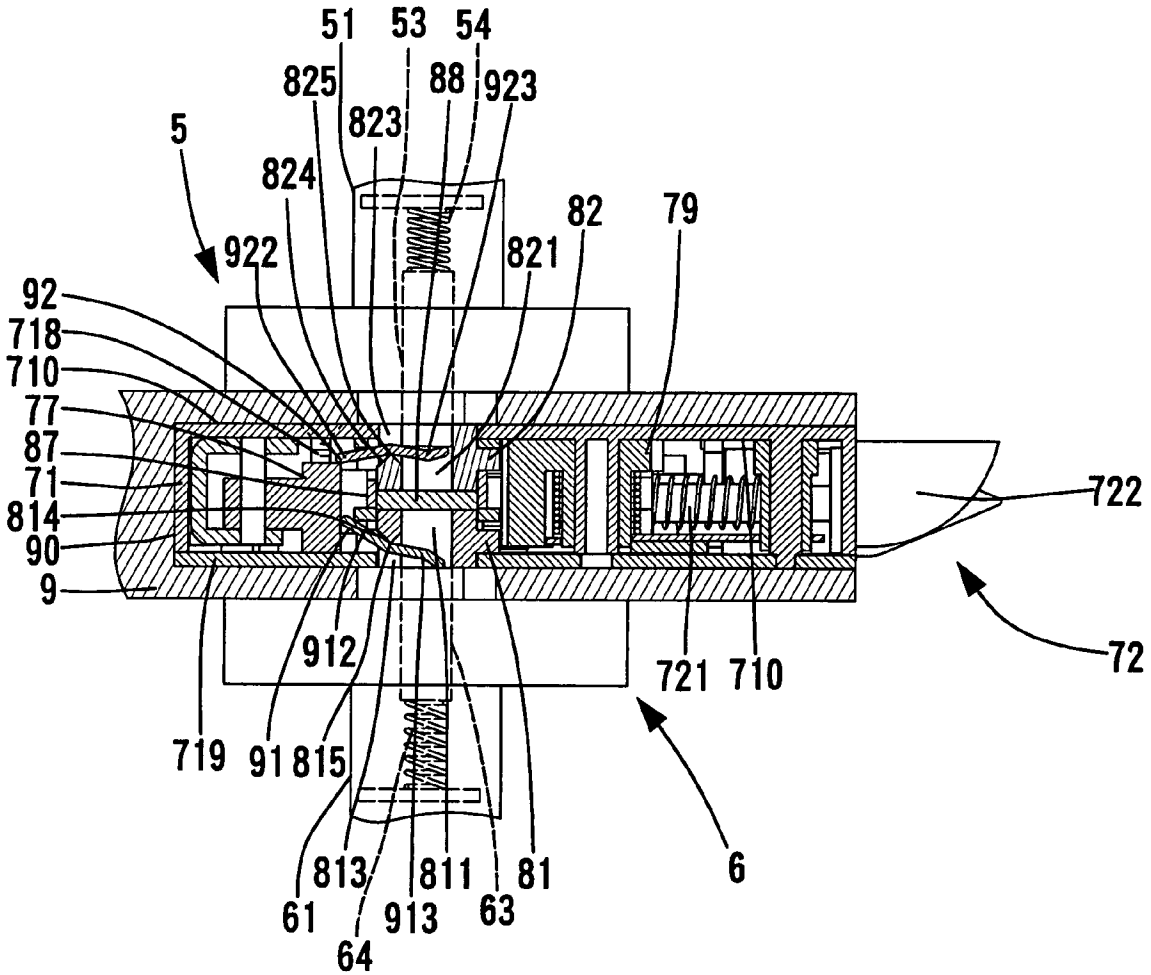
FIG. 11 is a view similar to FIG. 10, wherein the locking plug is moved leftward to lock the latch bolt.

In the embodiment shown in FIG. 10, when the thumb turn 830 is in the blocking position shown in FIG. 11, the face 770 of the locking plug 77 presses against the first end 912 of the lever 91 such that the second end 913 of the lever 912 presses against the outside spindle 63 and thus disengages the outside spindle 63 from the through-hole 811 of the wheel 81 as shown in FIG. 11. Thus, the latch bolt 72 is not retracted when the outside spindle 63 is turned, as the wheel 81 is not turned. In other words, the outside handle 61 pivots idly, preventing the internal elements of the lock from being damaged in a case that a relatively large force is applied to the outside handle 61. Operation of the inside handle 51 is not affected, as the inside spindle 53 is not moved.

Although a specific embodiment has been illustrated and described, numerous modifications and variations are still possible without departing from the essence of the invention. The scope of the invention is limited by the accompanying claims.

What is claimed is:

1. A lock comprising:

an inside handle including an end;

an inside spindle mounted to the end of the inside handle to turn therewith;

an outside handle including an end;

an outside spindle mounted to the end of the outside handle to turn therewith;

a body mounted between the inside handle and the outside handle, the body comprising a case and a lid for covering the case, the case including a front end face and a lateral side, an opening being defined in the front end face of the case, a latch bolt being retractably extended through the opening;

a first wheel pivotally mounted in the lateral side of the case, the first wheel including a through-hole into which the outside spindle extends, allowing joint rotation of the first wheel and the outside spindle, the first wheel being operably connected to the latch bolt such that turning of the first wheel causes retraction of the latch bolt, the first wheel further including a notch defined in a periphery thereof and communicated with the through-hole of the first wheel;

a second wheel pivotally mounted in the lid and including a through-hole into which the inside spindle extends, allowing joint rotation of the second wheel and the inside spindle, the second wheel being operably connected to the latch bolt such that turning of the second wheel causes retraction of the latch bolt;

a spring mounted in the end of the outside handle for biasing an end of the outside spindle into the through-hole of the first wheel, allowing joint rotation of the first wheel and the outside spindle;

a lever including a first end and a second end, the lever swayably extending through the notch of the first wheel, with the first end of the lever being located outside the first wheel and with the second end of the lever being located in the through-hole of the first wheel; and a locking plug mounted in the case and movable between an unblocking position in which the latch bolt is retracted when either of the inside handle and the outside handle is turned and a blocking position in which the latch bolt is retracted when the inside handle is turned;

wherein when the locking plug is in the blocking position, the locking plug presses against the first end of the lever and thus causes swaying movement of the lever, moving the second end of the lever to press against the end of the outside spindle to thereby move the outside spindle out of the through-hole of the first wheel such that the first wheel is not turned while the outside spindle is turned.

2. The lock as claimed in claim 1 wherein a bottom wall delimiting the notch of the first wheel includes a pointed protrusion acting a fulcrum for the lever.

3. The lock as claimed in claim 1 wherein the lever includes a recessed portion abutting against a bottom wall delimiting the notch of the first wheel.

4. The lock as claimed in claim 2 wherein the lever includes a recessed portion abutting against a bottom wall delimiting the notch of the first wheel.

5. The lock as claimed in claim 1 wherein the end of the outside spindle is located at an outer side of the second end of the lever.

6. The lock as claimed in claim 1 wherein the lock further includes a dead bolt and an auxiliary bolt, and wherein the front end face of the case includes two further openings through which the dead bolt and the auxiliary bolt are retractably extended.

7. A lock comprising:

a first handle including an end;

a first spindle mounted to the end of the first handle to turn therewith;

a second handle including an end;

a second spindle mounted to the end of the second handle to turn therewith;

a body mounted between the first handle and the second handle, the body comprising a case including two lateral sides and a front end face, an opening being defined in the front end face of the case, a latch bolt being retractably extended through the opening;

a first wheel pivotally mounted in the one of the two lateral sides of the case, the first wheel including a through-hole into which the first spindle extends, the first wheel being operably connected to the latch bolt such that turning of the first wheel causes retraction of the latch bolt, the first wheel further including a notch defined in a periphery thereof and communicated with the through-hole of the first wheel;

a second wheel pivotally mounted in one of the two lateral sides defining a lid and including a through-hole into which the second spindle extends, the second wheel being operably connected to the latch bolt such that turning of the second wheel causes retraction of the latch bolt;

a first spring mounted in the end of the first handle for biasing an end of the first spindle into the through-hole of the first wheel, allowing joint rotation of the first wheel and the first spindle;

a second spring mounted in the end of the second handle for biasing an end of the second spindle into the through-hole of the second wheel, allowing joint rotation of the second wheel and the second spindle;

a first lever including a first end and a second end, the first lever swayably extending through the notch of the first wheel, with the first end of the first lever being located outside the first wheel and with the second end of the first lever being located in the through-hole of the first wheel;

a second lever including a first end and a second end, the second lever swayably extending through a notch of the second wheel, with the first end of the second lever being located outside the second wheel and with the second end of the second lever being located in the through-hole of the second wheel; and a locking plug mounted in the case and movable between an unblocking position in which the latch bolt is retracted when either of the first handle and the second handle is turned and a blocking position in which the latch bolt is retracted when one of the first handle and the second handle is turned;

the locking plug being selectively mounted in one of two positions for selectively operating with one of the first lever and the second lever;

when the locking plug is in the blocking position, the locking plug presses against the first end of an associated one of the first lever and the second lever and thus causes swaying movement of the associated one of the first lever and the second lever, moving the second end of the associated one of the first lever and the second lever to press against the end of an associated one of the first spindle and the second spindle to thereby move the associated one of the first spindle and the second spindle out of the through-hole of an associated one of the first wheel and the second wheel such that the associated one of the first wheel and the second wheel is not turned while the other one of the first handle and the second handle is turned.

8. The lock as claimed in claim 7 wherein a bottom wall delimiting the notch of each of the first wheel and the second wheel includes a pointed protrusion acting a fulcrum for the associated one of the first lever and the second lever.

9. The lock as claimed in claim 7 wherein each of the first lever and the second lever includes a recessed portion abutting against a bottom wall delimiting the notch of the associated one of the first wheel and the second wheel.

10. The lock as claimed in claim 8 wherein each of the first lever and the second lever includes a recessed portion abutting against a bottom wall delimiting the notch of the associated one of the first wheel and the second wheel.

* * * * *